US005543579A

United States Patent [19]

Morinaga et al.

[11] Patent Number: 5,543,579

[45] Date of Patent: Aug. 6, 1996

[54] EFFECTOR

[75] Inventors: Masazumi Morinaga; Kousuke Takata, both of Osaka, Japan

[73] Assignee: Roland Corporation, Osaka, Japan

[21] Appl. No.: 378,264

[22] Filed: Jan. 26, 1995

[30] Foreign Application Priority Data

Jul. 22, 1994 [JP] Japan ..... 6-008919 U

[51] Int. Cl.[6] ..... G10H 1/02

[52] U.S. Cl. ..... 84/701; 84/DIG. 1; 84/DIG. 27; 381/61; 381/118

[58] Field of Search ..... 84/626–633, 662–665, 84/701–711, 737–741, DIG. 1, DIG. 27; 381/61–65, 118

[56] References Cited

U.S. PATENT DOCUMENTS

Re. 29,490 12/1977 Olms ..... 381/61

*Primary Examiner*—Stanley J. Witkowski

*Attorney, Agent, or Firm*—Ronald J. Kubovcik

[57] ABSTRACT

There is provided an effector for providing a musical tone with an effect such as a delay, a reverberation, a chorus and the like. The effector is capable of providing a feeling of listening such that the direct tone and the effect tone unites with each other, and in addition providing a feeling of expanse effective in a sound field. An effect tone signal is divided into a low register component and a high register component. The low register component is mixed with a musical tone signal (direct tone) entered through an input terminal and then outputted. The high register component is outputted in the form of stereophonic signal as it is.

6 Claims, 4 Drawing Sheets

EFFECTOR

BACKGROUND OF THE INVENTION

1. Field of the Invention

The present invention relates to an effector for providing a musical tone with an effect such as a delay, a reverberation, a chorus and the like.

2. Description of the Related Art

Hitherto, there is known an effector for providing a various kinds of effect upon receipt of a musical tone signal which will be obtained, for example, through pick-up with an electric guitar.

FIG. 4 is a front elevation of a speaker box which is connected to the conventional effector.

The speaker box 10 is provided with two speakers 11 and 12. A musical tone based on a direct musical tone signal before providing an effect, that is, a so-called direct tone emanates from the speaker 11. Whereas, a musical tone based on an effect tone signal after passing through an effector, that is, a so-called effect tone emanates from the speaker 12. The direct tone and the effect tone, which are outputted from the speakers 11 and 12, respectively, are synthesized in space and then received by an audience.

The effector includes a process for delaying a musical tone signal not only in case of the delay as an effect in which the direct musical tone signal is delayed, but also in a case where an effect such as reverberation, chorus and the like is provided. However, according to the above-mentioned scheme, providing a large delay time in the effector brings the fact that a sound image of the direct tone moves aside, whereas the effect tone moves in the other side. This involves such a problem that it is unnatural since a person hears separately the direct tone and the effect tone. Further, according to the above-mentioned scheme, the direct tone and the effect tone, which are separately outputted from the speakers 11 and 12, respectively, are synthesized in space. Hence, the synthetic ratio of the direct tone to the effect tone remarkably varies in accordance with a listening position at which an audience listens to musical tones outputted from the speakers 11 and 12. This involves such a problem that a feeling of orientation of the direct tone and the effect tone is poor.

As another scheme for providing a sound field with an expanse in which the direct tone and the effect tone are not separated from each other, it is considered that the direct tones are outputted from both the speakers 11 and 12 as shown in FIG. 4, and in addition an effector produces effect tone signals for a stereophonic reproduction so that the effect tone signals are outputted from the respective speakers 11 and 12. However, in this case, both the low register component and the high register component among the effect tone are applied to two speakers 11 and 12 and then outputted therefrom. Consequently, an audience would have simply a feeling of expanse such that the sound is working inside, and it is difficult to obtain a satisfactory effect on a musical basis.

SUMMARY OF THE INVENTION

In view of the foregoing, it is therefore an object of the present invention to provide an effector capable of providing a feeling of listening such that the direct tone and the effect tone unites with each other, and in addition providing a feeling of expanse effective in a sound field.

To achieve the above-mentioned object, according to the present invention, there is provided the first effector comprises:

(1—1) an input terminal for receiving a musical tone signal;

(1—2) an effect tone generating circuit for generating based on the musical tone signal entered through said input terminal effect tone signals for stereophonic reproduction which provide the entered musical tone signal with a predetermined effect;

(1—3) high-pass filters each for extracting a high register component of an associated one of the effect tone signals for stereophonic reproduction;

(1—4) a first adder circuit for adding the effect tone signals for stereophonic reproduction each other to produce a monaural effect tone signal;

(1—5) a low-pass filter for extracting a low register component of the monaural effect tone signal; and (1—6) a second adder circuit for adding the low register component of the monaural effect tone signal extracted by said low-pass filter to the musical tone signal entered through said input terminal to produce an addition signal.

To achieve the above-mentioned object, according to the present invention, there is provided the second effector comprises:

(2—1) an input terminal for receiving a musical tone signal;

(2—2) an effect tone generating circuit for generating based on the musical tone signal entered through said input terminal effect tone signals for stereophonic reproduction which provide the entered musical tone signal with a predetermined effect;

(2—3) high-pass filters each for extracting a high register component of an associated one of the effect tone signals for stereophonic reproduction;

(2—4) low-pass filters each for extracting a low register component of an associated one of the effect tone signals for stereophonic reproduction; and (2—5) an adder circuit for adding the low register components of the effect tone signals for stereophonic reproduction extracted by said low-pass filters each other and further adding to those the musical tone signal entered through said input terminal to produce an addition signal.

It is preferable that the first or second effector mentioned above further comprises a speaker box having a first speaker for outputting a musical tone based on the addition signal, and two second speakers each for outputting a musical tone based on an associated one of the high register components of the effect tone signals for stereophonic reproduction extracted by said high-pass filters, said second speakers being disposed at right and left of said first speaker, respectively. In this case, it is preferable that the first speaker outputs an overall compass of musical tones based on the musical tone signal entered through said input terminal.

According to the first or second effector of the present invention, an effect tone signal (effect tone) is divided into a low register component and a high register component. The low register component is mixed with a musical tone signal(direct tone) entered through an input terminal and then outputted. The high register component is outputted in the form of stereophonic signal as it is. The direct tone and the low register component of the effect tone are put together. Consequently, it is possible to prevent a sense of disharmony such that the direct tone and the effect tone are separated. Further, according to the present invention, the high register component of the effect tone, which will provide a feeling of expanse in sounds, is outputted on a stereophonic basis with separation from the low register component. Thus, reproducing the high register components of the stereophonic output through the respective speakers makes it possible to provide a feeling of expanse which is more preferable on a musical basis and more clear in sound field in comparison with a case that the effect tone including the low register component is stereo-reproduced in its entirety.

When the signals outputted from the first or second effector according to the present invention are reproduced, it is acceptable to use a speaker on the market different from the effector according to the present invention. However, providing the speaker box having the above-mentioned first speaker and the second speakers makes it possible to prepare in a set the effector and the speaker box having the speaker location and the reproduction compass or the like, which are deemed to be suitable for the effector concerned. In this case, it is preferable that the first speaker incorporated in the speaker box has a wide reproduction compass from the low register to the high register of the direct tone.

DESCRIPTION OF THE PREFERRED EMBODIMENTS

Hereinafter, there will be described embodiments of the present invention.

Figure 1:
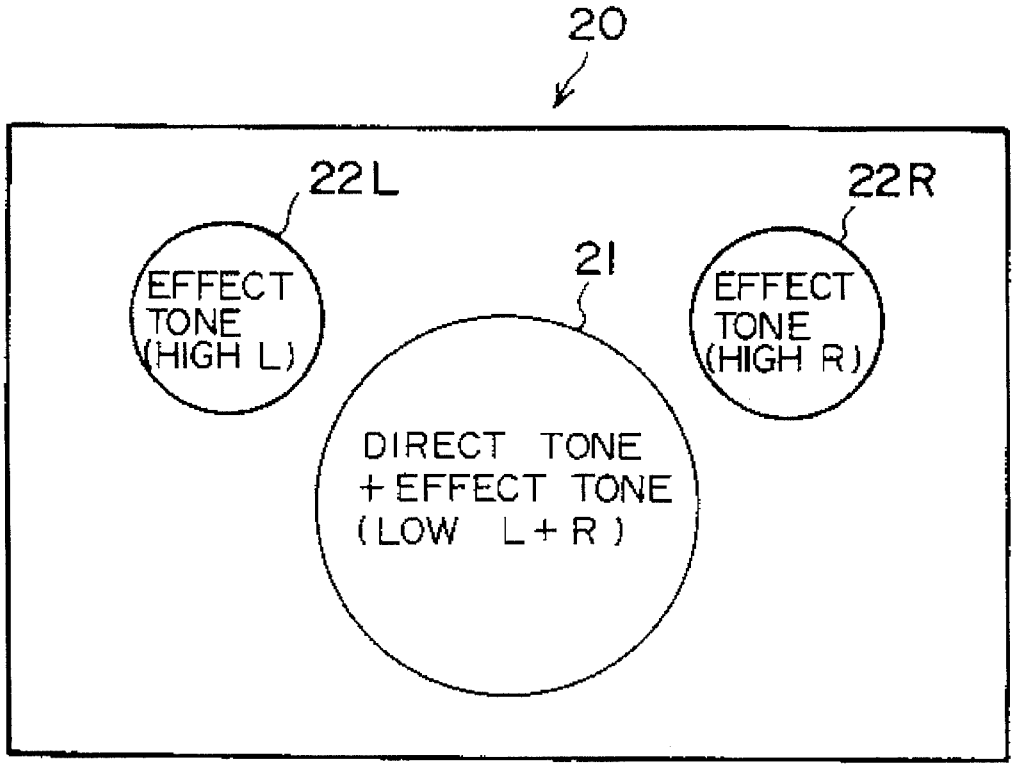
FIG. 1 is a front elevation of a speaker box according to an embodiment of the present invention.

FIG. 1 is a front elevation of a speaker box according to an embodiment of the present invention, which speaker box is involved in for example a guitar amplifier.

In FIG. 1, the speaker box 20 is provided with the first speaker 21 for use in reproduction of overall compass in the center, and two second speakers 22L and 22R each for use in reproduction of compass not less than 200 Hz by way of example, which speakers 22L and 22R are disposed at left and right of the first speaker 21 slightly upper, respectively. The first speaker 21 outputs a sound involved in a low register component of the direct tone and the effect tone. The second speakers 22L and 22R each output on a stereophonic reproduction basis a sound involved in a high register component of the effect tone.

Figure 2:
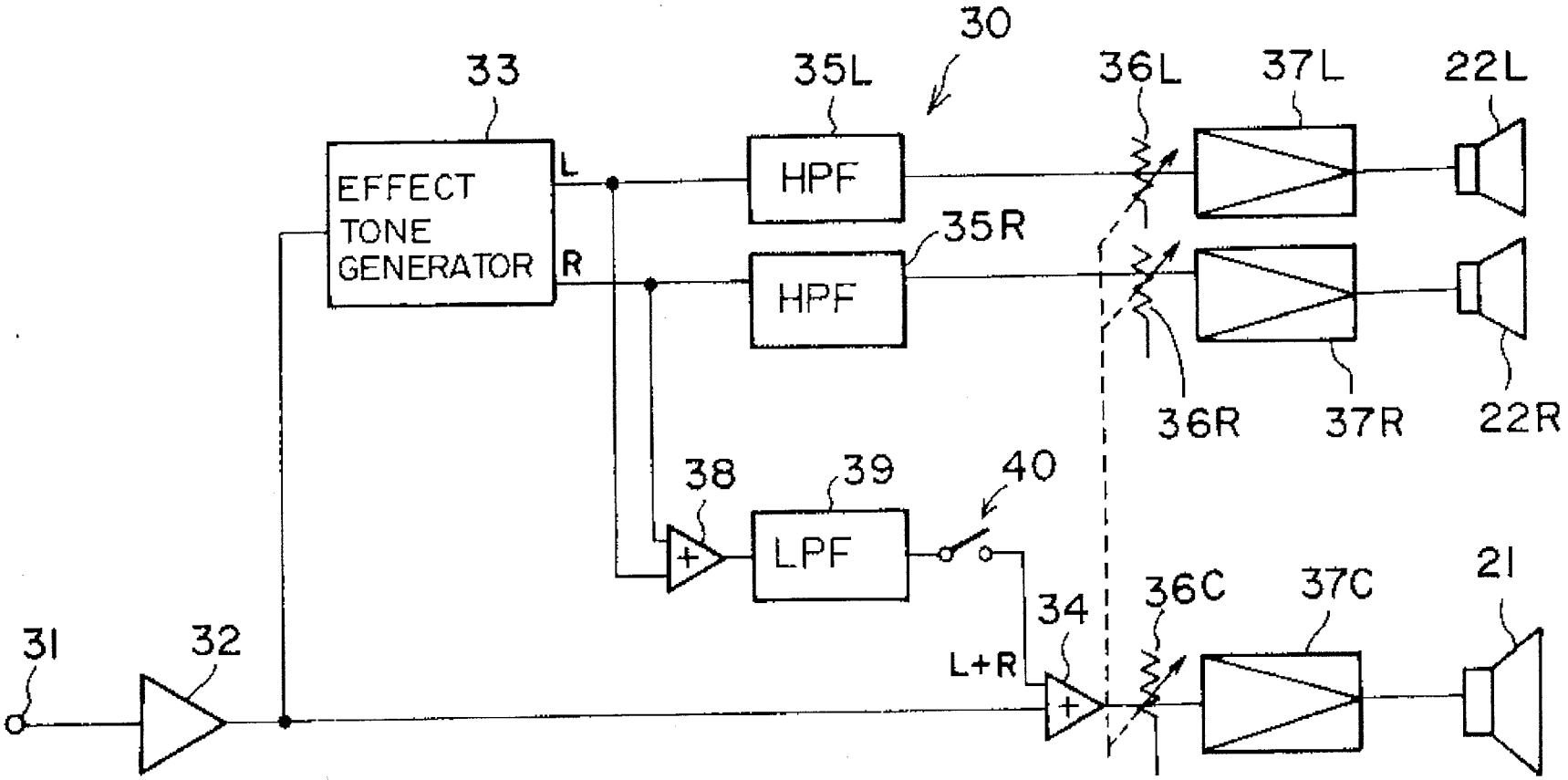
FIG. 2 is a block diagram showing an internal arrangement of an effector according to the first embodiment of the present invention.

FIG. 2 is a block diagram showing an internal arrangement of an effector according to the first embodiment of the present invention. In FIG. 2, the same parts are denoted by the same reference numbers as those of FIG. 1.

When the effector 30 receives a musical tone signal through an input terminal 31, the entered musical tone signal is amplified by an amplifier 32 and then applied to an effect tone generator circuit 33 and a second adder circuit 34.

The effect tone generator circuit 33 is arranged to generate effect tone signals for a stereophonic reproduction by means of providing the entered musical tone signal with a predetermined effect such as a delay, a reverberation, a chorus and the like. The effect tone signals for a stereophonic reproduction outputted from the effect tone generator circuit 33 are supplied to high-pass filters 35L and 35R each for extracting a high register component not less than 200 Hz by way of example among the received effect tone signals. The high register components of the effect tone signals for a stereophonic reproduction, which are extracted by the high-pass filters 35L and 35R, are passed via volume controls 36L and 36R to power amplifiers 37L and 37R, respectively. Output signals of the power amplifiers 37L and 37R are supplied to the second speakers 22L and 22R, respectively, so that sounds involved in the high register components of the effect tone based on the high register components of the effect tone signals for a stereophonic reproduction are outputted from the second speakers 22L and 22R.

Whereas the effect tone signals for a stereophonic reproduction outputted from the effect tone generator circuit 33 are also supplied to a first adder circuit 38 to be added so as to be converted into a monaural effect tone signal. An output of the first adder circuit 38 is applied to a low-pass filter 39 for extracting a low register component less than 200 Hz by way of example among the received effect tone signals. The low register component of the effect tone signals for a stereophonic reproduction, which is extracted by the low-pass filter 39, is passed via a switch 40 to an input of a second adder circuit 34. The second adder circuit 34 receives at the other input thereof the musical tone signal passing through the amplifier 32, so that the low register component of the effect tone signals from the low-pass filter 39 and the musical tone signal from the amplifier 32 are added each other. An output of the second adder circuit 34 is passed via a volume control 36C to a power amplifier 37C. An output signal of the power amplifier 37C is supplied to the first speaker 21, so that sounds involved in the low register components of the direct tone and the effect tone.

Incidentally, according to the present invention, there is provided the switch 40. Turning off the switch 40 permits sounds involved in the low register component of the effect tone to be eliminated.

In this manner, sounds involved in the low register components of the direct tone and the effect tone are outputted from the first speaker 21 disposed in the center of the speaker box 20 shown in FIG. 1, whereby an audience receives the direct tone and the effect tone as a united tone in a listening feeling. In addition, sounds involved in the high register components of the effect tone are outputted from the second speakers 22L and 22R on a stereophonic reproduction basis, whereby an audience has a feeling of expanse which is clear in a sound field.

Figure 3:
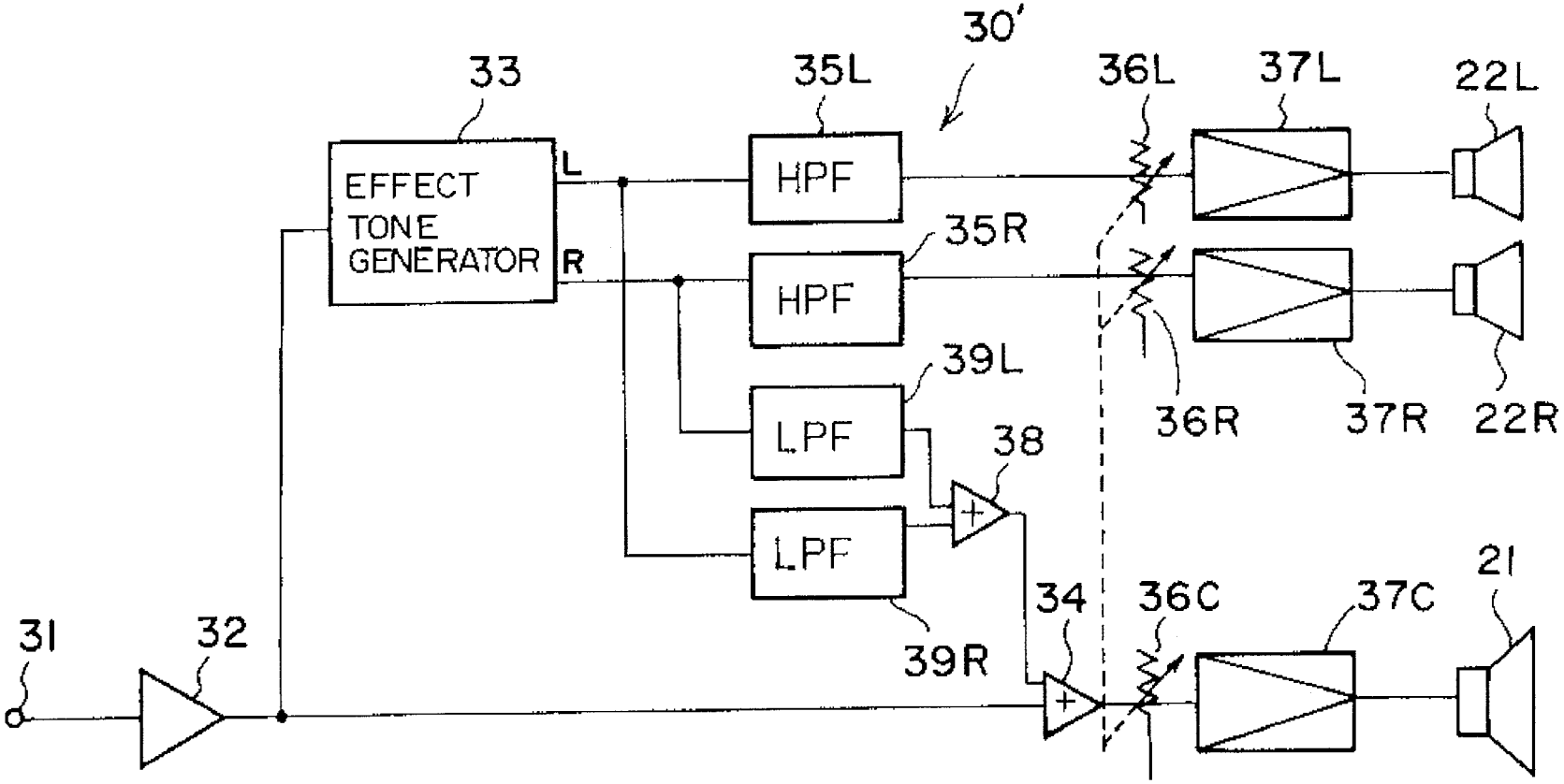
FIG. 3 is a block diagram showing an internal arrangement of an effector according to the second embodiment of the present invention.
Figure 4:
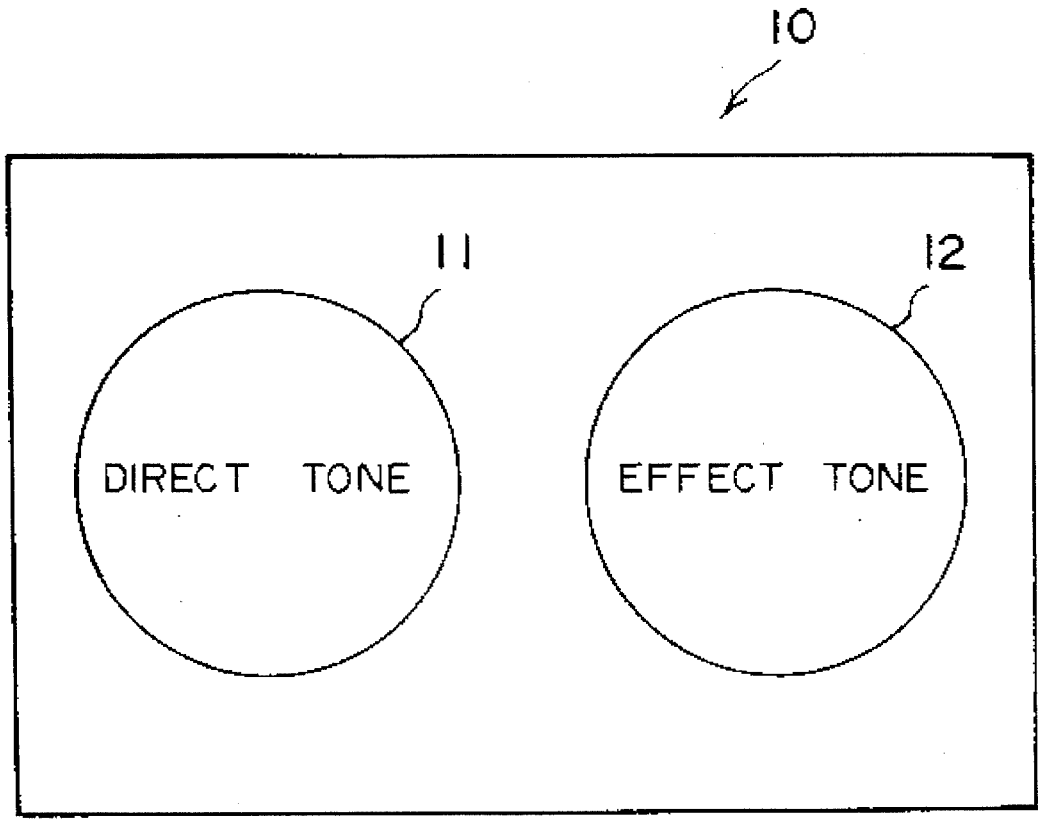
FIG. 4 is a front elevation of a speaker box which is connected to the conventional effector.

FIG. 3 is a block diagram showing an internal arrangement of an effector according to the second embodiment of the present invention. In FIG. 3, the same parts are denoted by the same reference numbers as those of FIG. 2. And the redundant description will be omitted.

According to the effector 30' shown in FIG. 3, the effect tone signals for a stereophonic reproduction, which are outputted from the effect tone generator circuit 33, are supplied to low-pass filters 39L and 39R each for extracting a low register component less than 200 Hz by way of example among the received effect tone signals. Outputs of the low-pass filters 39L and 39R are added by an adder circuit 38 so as to produce a monaural signal. The effector 30' shown in FIG. 3 is provided with no switch corresponding to the switch 40 shown in FIG. 2. Hence, the low register component of the effect tone signals is always added to the musical tone signal outputted from the amplifier 32. According to the present embodiment, the combination of two adder circuits 34 and 38 may be interpreted as one aspect of the claimed terminology "an adder circuit" in the present invention. In this manner, it is acceptable that either the low-pass filter or the adder circuit 38 is placed upstream with respect to the flow of signals.

As described above, according to the effector of the present invention, the direct tone and the effect tone are united, and it is possible to obtain a feeling of expanse which is clear in a sound field.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

We claim:

1. An effector comprising:

an input terminal for receiving a musical tone signal;

an effect tone generating circuit for generating based on the musical tone signal entered through said input terminal effect tone signals for stereophonic reproduction which provide the entered musical tone signal with a predetermined effect;

high-pass filters each for extracting a high register component of an associated one of the effect tone signals for stereophonic reproduction;

a first adder circuit for adding the effect tone signals for stereophonic reproduction each other to produce a monaural effect tone signal;

a low-pass filter for extracting a low register component of the monaural effect tone signal; and a second adder circuit for adding the low register component of the monaural effect tone signal extracted by said low-pass filter to the musical tone signal entered through said input terminal to produce an addition signal.

2. An effector according to claim 1, further comprising a speaker box having a first speaker for outputting a musical tone based on the addition signal, and two second speakers each for outputting a musical tone based on an associated one of the high register components of the effect tone signals for stereophonic reproduction extracted by said high-pass filters, said second speakers being disposed at right and left of said first speaker, respectively.

3. An effector according to claim 2, wherein said first speaker outputs an overall compass of musical tones based on the musical tone signal entered through said input terminal.

4. An effector comprising:

an input terminal for receiving a musical tone signal;

an effect tone generating circuit for generating based on the musical tone signal entered through said input terminal effect tone signals for stereophonic reproduction which provide the entered musical tone signal with a predetermined effect;

high-pass filters each for extracting a high register component of an associated one of the effect tone signals for stereophonic reproduction;

low-pass filters each for extracting a low register component of an associated one of the effect tone signals for stereophonic reproduction; and an adder circuit for adding the low register components of the effect tone signals for stereophonic reproduction extracted by said low-pass filters each other and further adding to those the musical tone signal entered through said input terminal to produce an addition signal.

5. An effector according to claim 4, further comprising a speaker box having a first speaker for outputting a musical tone based on the addition signal, and two second speakers each for outputting a musical tone based on an associated one of the high register components of the effect tone signals for stereophonic reproduction extracted by said high-pass filters, said second speakers being disposed at right and left of said first speaker, respectively.

6. An effector according to claim 5, wherein said first speaker outputs an overall compass of musical tones based on the musical tone signal entered through said input terminal.

* * * * *